US005848900A

United States Patent [19]

Pearson

[11] Patent Number: 5,848,900

[45] Date of Patent: Dec. 15, 1998

[54] EDUCATIONAL DOLL WITH CHANGEABLE FACE ELEMENTS

[76] Inventor: Linda C. Pearson, 27 Wendover Road, Toronto, Ontario, M8X 2L1, Canada

[21] Appl. No.: 933,526

[22] Filed: Sep. 18, 1997

Related U.S. Application Data

[60] Provisional application No. 60/026,543 Sep. 23, 1996.

[51] Int. Cl. [6] ..... G09B 23/00; A63H 3/02; A63H 3/16

[52] U.S. Cl. ..... 434/236; 446/321

[58] Field of Search ..... 434/236, 262; 446/321

[56] References Cited

U.S. PATENT DOCUMENTS

| | | | |
|---|---|---|---|
| 4,573,927 | 3/1986 | Newman . | |
| 4,762,494 | 8/1988 | Woods | 434/236 |
| 5,044,959 | 9/1991 | Shaver et al. . | |
| 5,215,493 | 6/1993 | Zgrodek et al. . | |
| 5,232,369 | 8/1993 | Mavrikis | 434/236 |
| 5,372,509 | 12/1994 | Brocato et al. | 434/236 |
| 5,403,224 | 4/1995 | Gintling | 446/321 |
| 5,405,266 | 4/1995 | Frank et al. . | |
| 5,439,407 | 8/1995 | Friedel | 434/236 |
| 5,676,584 | 10/1997 | Perryman | 446/321 |

FOREIGN PATENT DOCUMENTS 2 013 508 8/1979 United Kingdom .

*Primary Examiner*—Paul J. Hirsch

[57] ABSTRACT

A doll is described having changeable face elements. The doll includes (i) a soft, stuffed doll including a body portion, a pair of arms extending from the body portion, a pair of legs extending from the body portion and a head portion connected to the body portion via a neck portion. The head portion has a face portion surrounded by a projecting fabric fringe and the face portion has fixed thereto at spaced locations adjacent this fringe a plurality of fastener members comprising loop portions of loop and hook fasteners, such as Velcro® fasteners, these loop portions being adapted to represent locks or curls of hair on the face of the doll. The doll also include at least one attachable face element adapted for attachment to the face portion. This face element has fixed to the back face thereof a plurality of fastener members comprising hook portions of hook and loop fasteners, these hook fasteners being positioned to mate with the loop fasteners on the doll face.

5 Claims, 2 Drawing Sheets

EDUCATIONAL DOLL WITH CHANGEABLE FACE ELEMENTS

This application claims the benefit of U.S. Provisional Application No. 60/026,543, filed Sep. 23, 1996.

BACKGROUND OF THE INVENTION

This invention relates to dolls, in particular to educational dolls. Psychologists have, in recent years, identified emotional intelligence as an important determinant of success in life. Emotional, rather than intellectual, intelligence is emerging as the more important factor in happy relationships, job success, and overall life satisfaction. Fundamental to the development of emotional intelligence is the ability to recognize one's own feelings and express them in an appropriate manner. The present invention addresses the problem of promoting such abilities in children.

U.S. Pat. No. 5,405,266, issued to Frank and Neiman, discloses a psychotherapeutic doll with a featureless body and head and disproportionately long arms and legs. The therapy patient is provided with a number of face elements, each attached to the head of the doll with an elastic band so that the patient can express emotional states at a selected age in his life. Multiple face elements may be simultaneously attached to the head to convey one emotional state hidden by another. The usefulness of this invention is restricted to the psychotherapeutic setting as it has very limited appeal and usefulness as a plaything for children. The construction of the doll does not elicit identification on the part of a child, it lacks cuddliness, lovableness and charm, and the method of changing the doll's faces is unsatisfactory for play purposes.

U.S. Pat. No. 5,044,959, issued to Shaver et al. discloses a stuffed animal or doll which the child can use to express his feelings. The child places objects indicative of his emotional state into a frontal opening in the toy. Included with these objects are face disks with different expressions. The therapist can view the objects placed into the toy through a rear plate which can be opened. This doll is also generally restricted to a psychotherapeutic setting and is not useful as a plaything for a child.

U.S. Pat. No. 4,573,927, issued to Newman discloses a doll with a changeable face. However, this invention too is problematic and of limited use outside the psychotherapeutic setting. This doll, which is gender specific, has a hood overlapping the face into which a facial panel may be inserted and retained. Problems with this invention include: unattractiveness, a lack of cuddliness, a basic face which is blank and therefore unappealing or frightening to children, changeable faces which are not only limited in number (4), but which are also predominately negative, and finally, a clumsy method of changing the faces.

It is particularly desirable for educational dolls of this type that the doll itself be very appealing to the child and that the different facial expressions can easily be changed by the child. It is the particular object of the present invention to provide a stuffed doll with changeable face elements that is very safe and easy for a child to use and at the same time being very appealing to the child.

SUMMARY OF THE INVENTION

The present invention in its broadest aspect relates to a cuddly doll with changeable face elements comprising (i) a soft, stuffed doll including a body portion, a pair of arms extending from the body portion, a pair of legs extending from the body portion and a head portion connected to the body portion via a neck portion. The head portion has a face portion surrounded by a projecting fabric fringe and the face portion has fixed thereto at spaced locations adjacent this fringe a plurality of fastener members comprising loop portions of loop and hook fasteners, such as Velcro® fasteners, these loop portions being adapted to represent locks or curls of hair on the face of the doll and preferably being coloured to further enhance their appearance as hair. The doll also include at least one attachable face element adapted for attachment to the face portion. This face element has fixed to the back face thereof a plurality of fastener members comprising hook portions of hook and loop fasteners, these hook fasteners being positioned to mate with the loop fasteners on the doll face.

According to a preferred feature, a ribbon formed of a loop portion of a loop and hook fastener is placed around the neck of the doll. The attachable face element also has a neck portion extending downwardly therefrom with hook portions of hook and loop fasteners fixed to the back face of the face element neck portion. These hook portions are adapted to mate with the ribbon loop portion around the neck of the doll, thereby securely holding the bottom portion of the face element.

The projecting fabric fringe is preferably formed from a lace material which is decorative on the doll and also can simulate a fringe of a bonnet. The fastener loop portions attached to the face of the doll can be shaped and coloured to simulate locks or curls of hair on the face of the doll. Because these loop portions appear as a soft fabric somewhat like velvet on the face of the doll, they compliment the generally soft feel of the doll and appear as simply decorative portions rather than functional components for attaching face elements. Thus, these connector elements in no way detract from the appearance or play value of the doll when a face element is not attached.

The same is true with respect to the loop portions forming part of a ribbon around the neck of the doll. They simply appear as a part of a soft ribbon surrounding the neck of the doll.

The doll of this invention is preferably produced in the form of a soft and cuddly stuffed doll which is soft and easy to hold by a child, e.g. in the form of a rag doll. The entire outer surface of the doll is preferably formed of cloth pieces sewn together, with the connector loop portions being also sewn to the face. Thus, children can easily identify with it and will, therefor, be more likely to use it as a plaything and profit from its didactic qualities. The doll may be provided with a variety of different changeable faces that are cute and depict different emotional states in a nonthreatening way. The particular feature of the present invention is that the different faces can be changed with great ease. Thus, a child simply places a different face element over the doll's basic face and it immediately adheres by way of the loop and hook fasteners. These face elements are also preferably formed of cloth with the connector hook portions being sewn to the cloth face element. To change the face, the child simply pulls off the face element and replaces it with another one. This method requires a minimum of patience, manual dexterity and conceptual organizational skills. As a consequence, even very young, preverbal and nonverbal children can play with this doll and change its faces. This means that the development of emotional intelligence utilizing the present invention is not limited to older, brighter or more dexterous children.

Dolls have previously been produced having changeable face elements held by burr-type or loop and hook fasteners such as Velcro® fasteners. However, they were not successful primarily because they had no appeal for children; they simply were not interested in the dolls. In the prior dolls, strips of Velcro® fastening were simply placed around the periphery of the face portion of the doll. These had the appearance of bandages which had no appeal. The problem was solved by the present invention by using on the face portion of a doll pieces of loop portions of Velcro® fasteners which are positioned and shaped to look like locks or curls of hair. They are also preferably coloured, e.g. yellow, black, brown, red, etc. and this colouring together with the shape, location and softness of the loop portions of the fasteners result in items on the face of the doll that no longer appear as simple functional items but as aesthetic design features of the face. The result of this is that children see the doll of the invention only as a cute, cuddly doll and are totally unaware of anything unusual about the doll's face. They see only a doll with pretty curls.

The result is a cuddly doll having changeable faces which is not only safe and easy to use but also one which is highly appealing to children and having excellent general play value.

BRIEF DESCRIPTION OF THE DRAWINGS

Certain preferred embodiments of the present invention are illustrated in the following drawings wherein.

DESCRIPTION OF THE PREFERRED EMBODIMENTS

Figure 1:
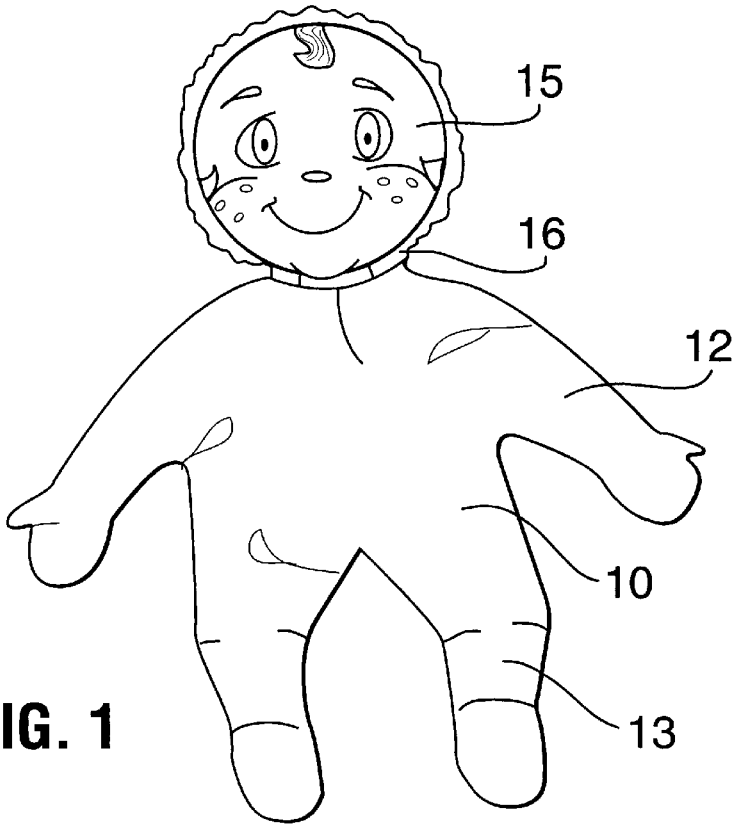
FIG. 1 is a frontal view of the doll.
Figure 2:
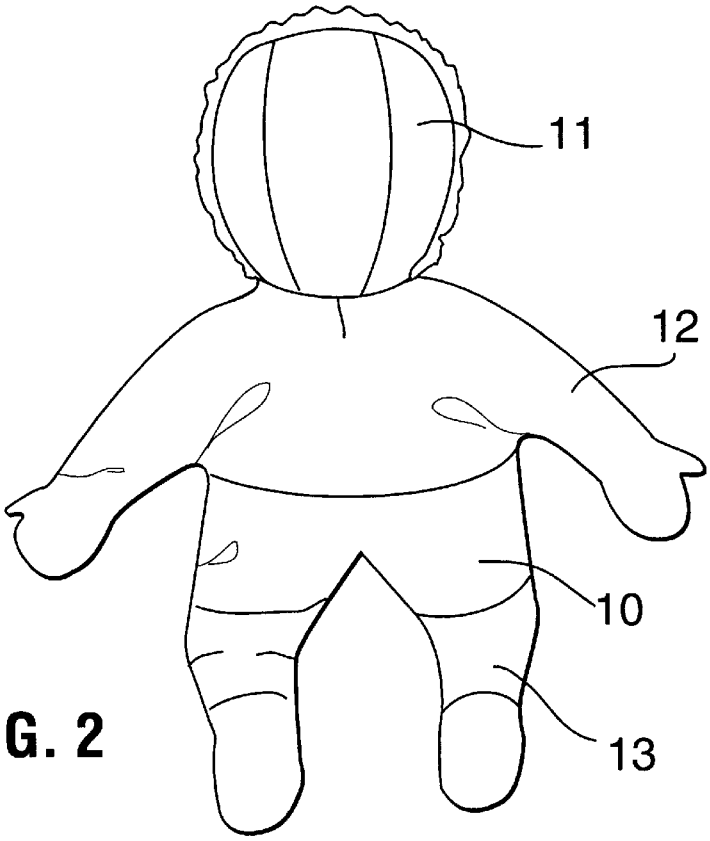
FIG. 2 is a back view of the doll.

As seen in FIGS. 1 and 2, the doll is a soft, stuffed doll having a body portion 10 with a head portion 11 connected thereto. It also has arms 12 and legs 13. The head portion 11 includes a face 15. Also as seen from FIG. 1 is a neck portion 16.

Figure 3:
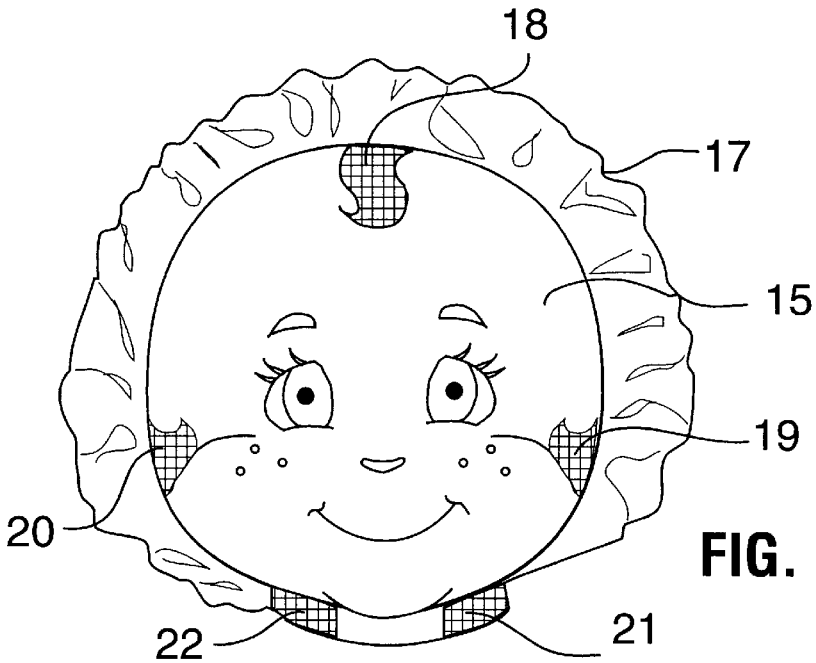
FIG. 3 is a detailed view of the dolls basic face.

Surrounding the face is a fringe 17 preferably formed of a lace-like material which may represent the fringe of a bonnet. Fixed to and extending onto the face 15 from the edge of this fringe 17 are portions of loop material of loop and hook fasteners, e.g. Velcro® fasteners. As seen particularly from FIG. 3, three fasteners pieces 18, 19 and 20 may conveniently be used and positioned to simulate locks or curls of hair. Thus, these pieces of connector loops appear as soft pieces of velvet-like fabric attached to the face and forming a natural part of the face of the doll. They are coloured to appear as a doll having blonde, black, brown or red hair.

The neck portion 16 of the doll is also surrounded by a ribbon having pieces of connector loops 21 and 22 attached thereto. These also appear as soft fabric materials forming part of the neck ribbon.

Figure 4:
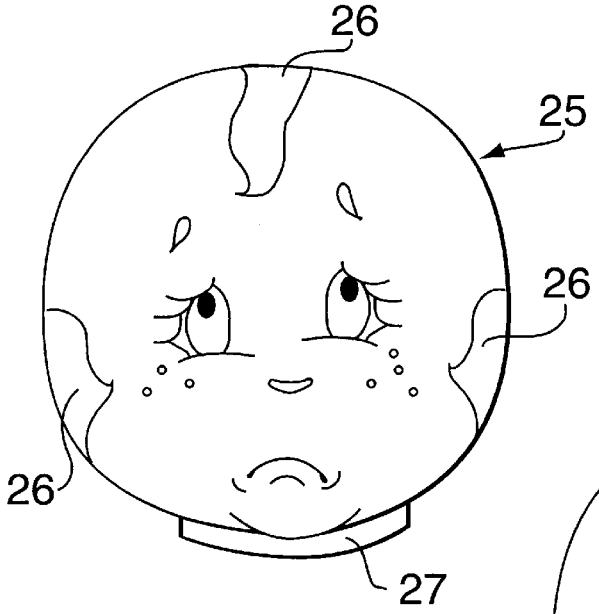
FIG. 4 is a frontal view of one changeable face element.
Figure 5:
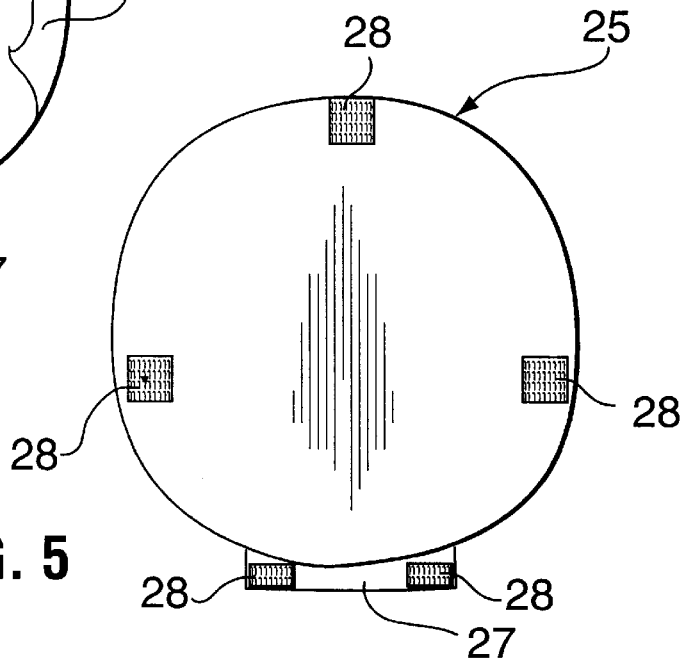
FIG. 5 is a back view of the face element of FIG. 4.

One example of a changeable face element is shown in FIGS. 4 and 5. The face element has a facial expression showing any desired mood and may include an indication of curls or locks of hair 26 which are similar to the designs of the loop connector portions 18, 19 and 20 on the doll face. The face element also includes a neck portion 27. As seen from FIG. 5, five pieces of hook portions 28 of loop and hook fasteners are connected to the face and neck portions as shown. These are positioned to mate with the loop portions 18, 19, 20, 21 and 22 of the face.

While the invention has been described herein relative to its preferred embodiment, it is of course contemplated that modifications of, and alternatives to, this embodiment, such modifications and alternatives obtaining the advantages and benefits of this invention, will be apparent to those of ordinary skill in the art having reference to this specification and its drawings. It is contemplated that such modifications and alternatives are within the scope of this invention as subsequently claimed herein.

I claim:

1. A cuddly doll with changeable face elements comprising (i) a soft, stuffed doll including a body portion, a pair of arms extending from said body portion, a pair of legs extending from said body portion and a head portion connected to said body portion, said head portion having a face portion surrounded by a projecting fabric fringe and said face portion having fixed thereto at spaced locations adjacent said fringe a plurality of fastener members comprising loop portions of loop and hook fasteners, said loop portions being adapted to represent locks or curls of hair on the face of the doll and (ii) at least one attachable face element adapted for attachment to said face portion, said face element having fixed to the back face thereof a plurality of fastener members comprising hook portions of loop and hook fasteners, said hook fasteners being adapted to mate with the loop fasteners on the doll face and wherein said doll also includes a ribbon formed of a loop portion of a loop and hook fastener placed around the neck of the doll, and wherein said attachable face element has a neck portion extending downwardly therefrom with hook portions of loop and hook fasteners fixed to the back face of the face element neck portion and being adapted to mate with the ribbon loop portion around the neck of the doll.

2. A doll according to claim 1 wherein the doll is a sewn cloth doll with a cloth face.

3. A doll according to claim 2 wherein the attachable face element is formed of cloth.

4. A doll according to claim 3 wherein the fastener members are sewn to the doll face and to the attachable face elements.

5. A doll according to claim 4 wherein the fastener loop portions adapted to represent locks or curls of hair are coloured to appear as blonde, black, brown or red hair.

* * * * *